US009289067B2

(12) United States Patent
Meyer et al.

(10) Patent No.: US 9,289,067 B2
(45) Date of Patent: Mar. 22, 2016

(54) PIECE OF SEATING FURNITURE

(75) Inventors: Stephan Meyer, Freiburg (DE); Peter Wagner, Neusäss/Westheim (DE)

(73) Assignee: Stephan Meyer, Freiburg (DE)

( * ) Notice: Subject to any disclaimer, the term of this patent is extended or adjusted under 35 U.S.C. 154(b) by 37 days.

(21) Appl. No.: 14/113,483

(22) PCT Filed: May 4, 2012

(86) PCT No.: PCT/DE2012/000467

§ 371 (c)(1),
(2), (4) Date: Oct. 23, 2013

(87) PCT Pub. No.: WO2012/152252

PCT Pub. Date: Nov. 15, 2012

(65) Prior Publication Data

US 2014/0054941 A1 Feb. 27, 2014

(30) Foreign Application Priority Data

May 12, 2011 (DE) ..... 10 2011 101 388
Dec. 22, 2011 (DE) ..... 20 2011 109 394 U

(51) Int. Cl.

| | |
|---|---|
| ***A47C 1/00*** | (2006.01) |
| ***A47C 3/025*** | (2006.01) |
| ***A47C 7/14*** | (2006.01) |
| ***A47C 9/00*** | (2006.01) |

(52) U.S. Cl.

CPC ..... *A47C 3/0255* (2013.01); *A47C 7/14* (2013.01); *A47C 9/002* (2013.01)

(58) Field of Classification Search

CPC ..... A47C 9/002; A47C 3/025; A47C 3/026; A47C 3/0255; A47C 7/14

See application file for complete search history.

(56) References Cited

U.S. PATENT DOCUMENTS

| | | | | |
|---|---|---|---|---|
| 5,577,803 | A * | 11/1996 | Guilbaud | 297/314 |
| 5,769,492 | A | 6/1998 | Jensen | |
| 5,976,097 | A * | 11/1999 | Jensen | 601/24 |
| 6,413,194 | B1 * | 7/2002 | Gant | 482/112 |
| 2002/0060486 | A1 | 5/2002 | Meyer | |
| 2008/0191525 | A1 * | 8/2008 | Jensen et al. | 297/217.2 |
| 2009/0058156 | A1 * | 3/2009 | Gang | 297/312 |
| 2010/0181815 | A1 | 7/2010 | Highlander | |

FOREIGN PATENT DOCUMENTS

| | | | |
|---|---|---|---|
| DE | 202006017136 | U1 | 1/2007 |
| DE | 202009011135 | U1 | 12/2009 |
| WO | 2006/089333 | A1 | 8/2006 |

* cited by examiner

*Primary Examiner* — Philip Gabler
(74) *Attorney, Agent, or Firm* — Gudrun E. Huckett

(57) ABSTRACT

A piece of seating furniture has a seat plate (1) with a lower seat framework (2) arranged on the underside of said seat plate (1). Also provided is a tilting device (4), by means of which the person sitting on the piece of furniture can execute a tilting movement about a point of rotation located in the seat region. The tilting device (4) is formed by a structural unit which is separate from the seat plate (1) and is arranged on the seat plate (1) of the piece of furniture.

14 Claims, 5 Drawing Sheets

PIECE OF SEATING FURNITURE

BACKGROUND OF THE INVENTION

The invention concerns a piece of seating furniture comprising a seat plate, a seat substructure arranged at the bottom side of the seat plate as well as a tilting device by means of which the person seated on the piece of seating furniture can perform a tilting movement about a pivot point arranged within the seating area.

Pieces of seating furniture according to the invention are to be understood in the most common sense. They may be in the form of chairs for domestic use, office chairs, office armchairs, stools etc., but also vehicles seats, airplane seats, cinema seats etc.

Pieces of seating furniture that enable a tilting movement of the seat plate about a pivot point located at the central seating area are known in various embodiments. The basic principle resides always in that on the bottom side of the seat plate a support employing an elastic body is arranged. This elastic body counteracts the tilting movement with an appropriate restoring force.

A disadvantage of these known tilting devices in connection with pieces of seating furniture is that the seat top structure resting on the seat substructure always tilts in its entirety; a person sitting thereon experiences this as a rather wobbly sensation.

Based on this, it is an object of the present invention to provide a piece of seating furniture of the aforementioned kind with an improved tilting behavior.

SUMMARY OF THE INVENTION

The technical solution is characterized by the tilting device being formed by a unit that is separate relative to the seat plate, which unit is arranged on the seat plate of the piece of seating furniture and on which the person is seated directly.

In this way, a piece of seating furniture is provided which is characterized by an improved tilting behavior. The basic idea of the piece of seating furniture according to the invention resides in that the top structure which is resting on the seat substructure, i.e., primarily the seat plate that forms the seat bottom structure or at least part thereof, optionally also armrests as well as the backrest, do not tilt in their entirety but instead only the actual seating area of the seat plate performs a tilting movement. The tilting movement occurs precisely where the person is seated on the seat plate, i.e., on the tilting device. In this context, the tilting device is no longer arranged, as in the past, below the seat plate but instead above the seat plate, in accordance with the invention. However, this does not preclude that, in addition to the tilting device according to the invention, a—conventional—tilting device is provided between the seat plate and the seat substructure. The seat plate can also be connected absolutely rigidly with the seat substructure. In this context, the seat plate is to be understood in the most general sense such that it is a plate-shaped structure, no matter which circumferential contour it has. Also, profilings of the topside as well as of the bottom side of this seat plate are discretionary. The tilting device is a separate unit which can be arranged on the top side of the seat plate. This has also the advantage that one and the same seat plate can be furnished with different tilting devices, as needed. As a whole, the person that is sitting on the piece of seating furniture with the novel tilting device no longer experiences the wobbly sensation as the tilting movement occurs; instead, the tilting compensation movements occur only within the pelvis and hip area of the person. The tilting device can be designed such that any desired tilting movement is possible. For example, it is possible that only a tilting movement to the front and to the rear is possible, that only a lateral tilting movement is possible, that only a tilting movement to the front and to the rear as well as a lateral tilting movement are possible, that a tilting movement in any direction is possible, etc. Also, it is conceivable that tilting movements in several directions are possible but that in this context certain directions are preferred by means of a special configuration of the tilting device, for example, by an angle-dependent restoring force.

According to the invention, the tilting device can have at the topside a tilting seat disk on which the person is sitting. This tilting seat disk is substantially rigid but can be provided with any profiling with regard to the topside, the bottom side as well as the circumferential contour; it functions during the tilting movement like a seesaw. Basically, it is however also possible that the tilting device has no such tilting seat disk. This is particularly the case when the tilting device is embodied like a cushion filled with flexible contents, as will be disclosed in more detail infra. When using such a cushion, the cushion may have in principle also a tilting seat disk.

According to the invention, the circumferential rim of the tilting seat disk can have a spacing relative to the topside of the seat plate that is arranged underneath. This means that relative to this intermediate spacing a corresponding tilting movement, i.e., slant of the tilting seat disk relative to the seat plate, can be performed.

Alternatively, the invention proposes that in the rim area between the tilting seat disk and the seat plate one or several spring elements are arranged therebetween. This means that the tilting seat disk is supported in a springy fashion in the rim area.

Preferably, the tilting device has at the bottom side a support element. This support element defines a tilting point or a tilting area from where the person seated on the seat can carry out tilting movements laterally, forwardly, rearwardly, or within all angle ranges. The support element can be centrally arranged at the center of the tilting device or—generally—at the central area of the tilting device. Also, an arrangement of the support element that is displaced relative to the precise center is conceivable. At the same time, it is also conceivable that several support elements are provided. The support elements can be embodied moreover substantially in a punctiform shape or in the form of a tilting bar. When using a tilting bar, a tilting movement would be possible only in a certain direction while, for a punctiform support element, a tilting movement in all circumferential directions would be possible. This also encompasses that certain tilting movements are preferred as a result of the adjustment of the restoring force.

According to the invention, the support element can be designed as a rigid body. It only must serve to allow a person seated on the tilting device to perform a tilting movement. For example, the rigid support element can be designed as a semi-spherical structure. But also other profilings, for example, in the form of an ellipsoid, are conceivable in order to enable a preferential movement, for example, forward and rearward, for a tilting movement while also permitting a lateral tilting movement is permitted however.

The invention further proposes however that the supporting element is an elastic element. This means that during the tilting movement a tensioning force is created which attempts to return the tilting seat disk into the initial horizontal position. This means that the person must overcome a counterforce during the tilting movement of the person. As already discussed above, this elastic spring element can be universally designed with regard to its arrangement as well as configuration. For example, an exact central arrangement of the elastic spring element is possible, but also an off-center arrangement.

According to a further embodiment, the actual seat plate can have a flat topside on which the tilting device is resting. In this way, a very flat complete configuration of the seating area of the piece of seating furniture is provided. In this case, the tilting support, in particular when it is designed as an elastic tilting support, is preferably realized within the central area. But also an off-center tilting support is conceivable. The flat topside is to be understood in the most general sense. It can be planar but also surface-profiled.

Alternatively, the seat plate has a depression within which the tilting device is arranged. This means that the tilting device is embedded in this depression of the seat plate. In this context, the topside of the tilting device forms with the topside of the rim area of the seat plate a flush surface. This circumferential rim of the seat plate also imparts a high stability to the latter. Accordingly, the tilting device with its tilting seat disk is arranged recessed in such a way within this depression of the seat plate that in the rest position the topside of the tilting seat disk forms with the topside of the rim area of the seat plate a substantially flush surface and that, starting from this rest position, the tilting device with its tilting seat disk is tiltable within the depression.

According to the invention, the tilting device is arranged exclusively within the depression. This means that the tilting device with its circumferential contour reaches only to the inner contour of the depression without radially projecting past the depression. This means that the tilting device is embedded completely in the depression.

Alternatively, the circumferential rim of the depression of the seat plate is elastic wherein the circumferential area of the tilting seat disk is resting on this elastic circumferential rim. In this way, a very compact and effective spring support of the tilting seat disk in the circumferential area is provided. Nonetheless, it is also conceivable that the tilting seat disk in the central area is also additionally provided with an elastic support.

A preferred embodiment proposes that the tilting device is formed by a cushion of sorts. This cushion is filled with a flowable medium, for example with air, with water, with a viscous gel etc. This cushion can be provided at its topside with a plate-shaped substantially rigid tilting seat disk which thus is floatingly supported on the cushion in the manner of a seesaw. However, it is also conceivable that no such tilting seat disk is present so that the person is directly seated on the cushion. It is also conceivable that the cushion has an additional support body. This support action can be provided within the central area of the cushion but also off-center in order to affect the tilting properties of the tilting device. Also, several support bodies can be provided. Also, the shape of the support body is discretionary, for example, in the form of a semi-sphere, a tilting bar etc. Preferably, this support is a rigid body. It can however also be elastic. The cushion, of course, can also be used without support body. When using such a cushion as a tilting device, upon a tilting movement of the person seated thereon, the flowable material contained in the cushion is forced from one area into another area. At the location where the flowable material flows to, the cushion will bulge and therefore create, as a whole, a slanted position for generating the tilted position. Accordingly, the cushion of the tilting device can be arranged in the afore described depression within the seat plate. This provides the cushion with lateral hold and a lateral boundary. Of course, the cushion of the tilting device can also be located on the flat topside of the seat plate (i.e., without depression).

As an alternative to the cushion, according to a further preferred embodiment, as a tilting device an annular hose can be provided also which is filled with a flowable medium, in particular air, water, or a gel. This annular hose can either be circular or can also be designed to have an oval shape. Also, the cross-sectional contour of the hose body can be discretionary. For example, this cross-sectional contour can either be round or oval or formed differently. Preferably, this annular hose has at the topside a tilting seat disk on which the person is seated. This tilting seat disk can have, but must not have, a support element at the bottom side. The support element is located in the central opening of the ring and penetrates through it. This central opening of the annular hose can extend up to the support element so that in this way a certain centering action is provided. Particularly the use of an annular hose as a tilting device has the advantage that additionally the aforementioned support element can also be positioned without a problem below the tilting seat disk. According to the shape and profiling of the ring and optionally of the support element, tilting characteristics can be adjusted in a targeted fashion.

Moreover, the invention proposes that the seat plate together with the tilting device has a common cover. This means that with regard to the outer appearance it is not apparent that an additional tilting device is arranged on the actual seat plate.

Finally, the invention proposes that the seat plate and the seat substructure are either rigidly connected to each other or by means of a tilting mechanism, a synchronizing mechanism, or—generally—a movement mechanism concerning the seat surface, the backrest as well as the armrests etc. as they are known from the prior art. In the variant in which the seat plate is rigidly connected to the seat substructure, the tilting device, as the one and only means, provides the tilting movement. It is however also alternatively possible that in addition to this tilting device—in a conventional way—the seat plate is arranged tiltably on the seat substructure or that a synchronizing mechanism is provided which synchronizes the tilting movement of the seat surface with the tilting movement of the backrest. The combination with other known movement devices is also conceivable. As a whole, this means superimposed tilting movements of the person seated on the piece of seating furniture. The elastic restoring forces between the two tilting devices can be different in this context.

BRIEF DESCRIPTION OF THE DRAWINGS

Embodiments of a piece of seating furniture according to the invention will be explained in the following with the aid of the drawings. It is shown therein in.

DESCRIPTION OF PREFERRED EMBODIMENTS

Figure 1A:
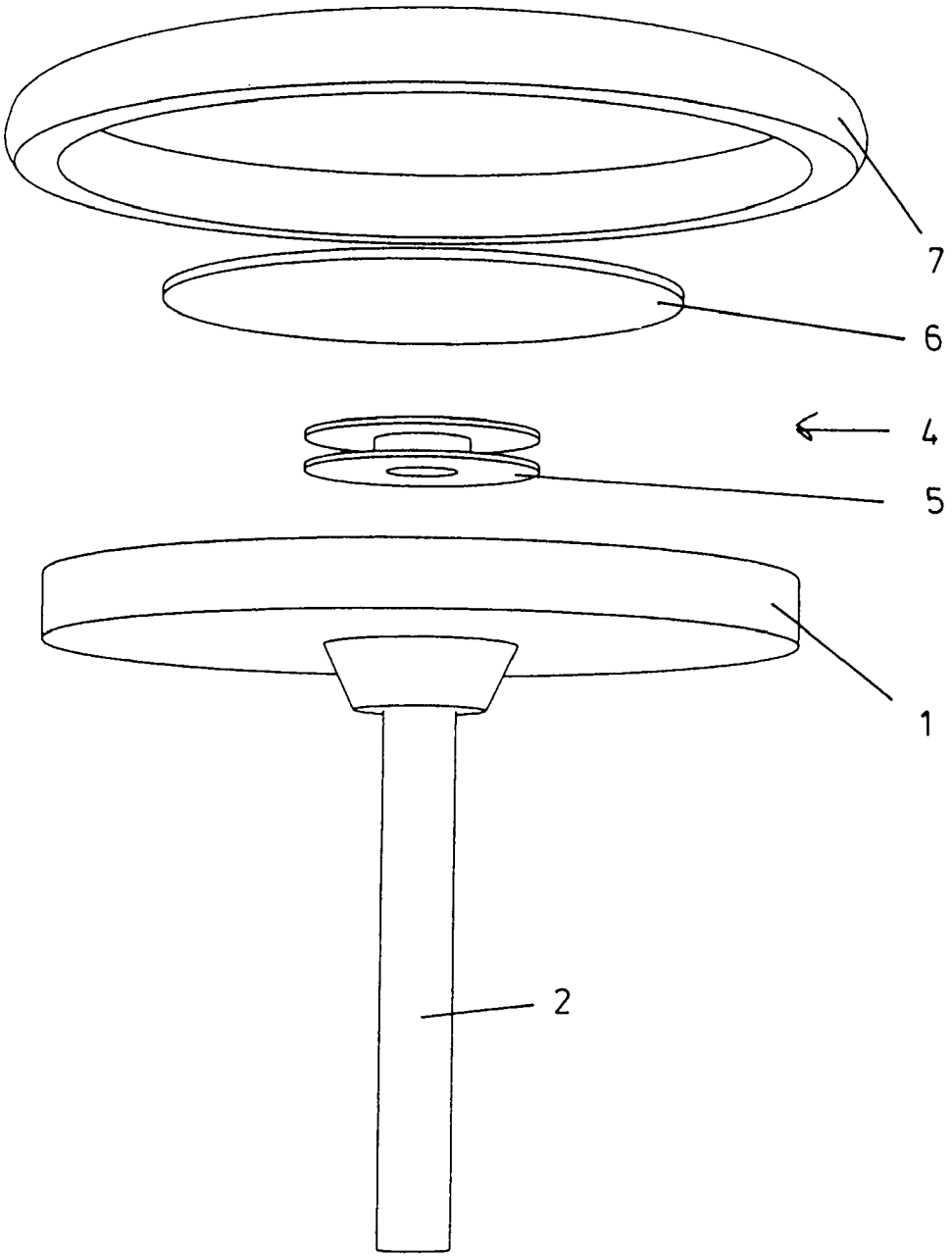
FIG. 1*a* a schematic exploded view of the piece of seating furniture from below.
Figure 1B:
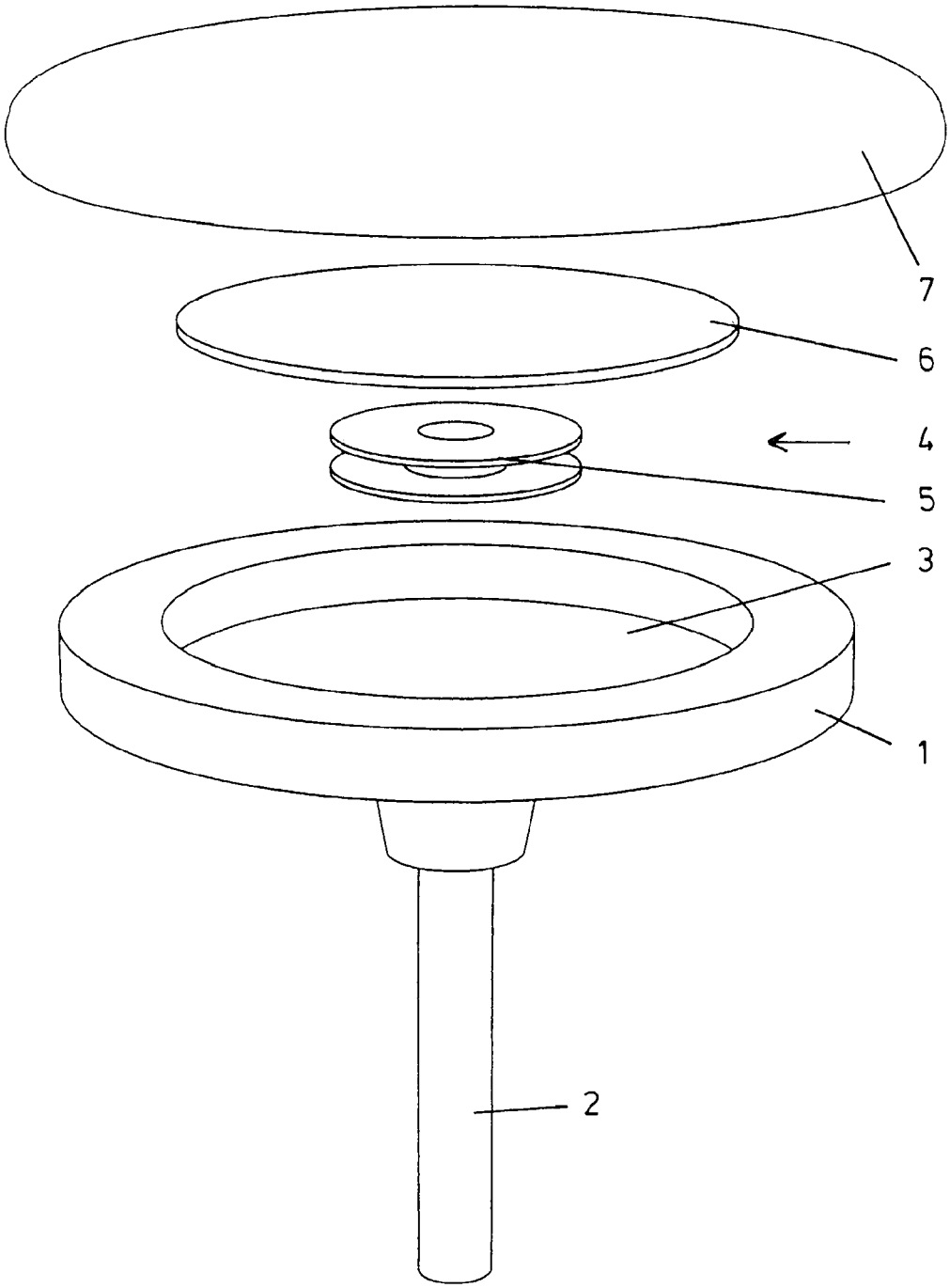
FIG. 1*b* a schematic exploded view of the piece of seating furniture from above.

The piece of seating furniture, as illustrated in FIGS. 1*a* and 1*b* in exploded views purely schematically, has a seat plate 1 which is arranged on a seat substructure 2.

The seat plate 1, as can be seen in particular in FIG. 1*b*, is shaped to have a depression. In this depression 3 of the seat plate 1, there is a tilting device 4 with a support element 5 and a tilting seat disk 6 arranged thereon. Finally, a cover 7 is provided.

FIGS. 2*a* to 2*f* show in section illustrations various embodiments of the piece of seating furniture.

Figure 2A:
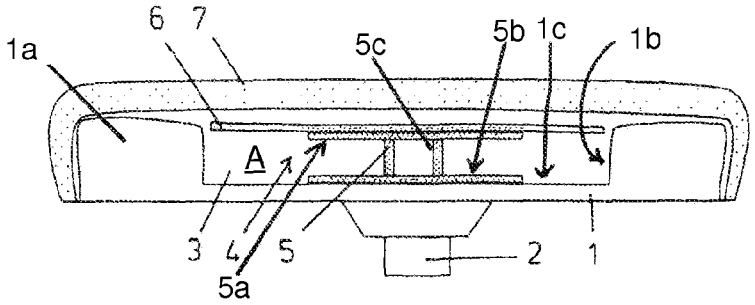
FIGS. 2*a* to 2*f* section illustrations of the piece of seating furniture in various embodiments.

FIG. 2*a* shows essentially the embodiment variant as it has already been illustrated in the exploded illustrations of FIGS. 1*a* and 1*b*. The seat plate 1 has accordingly a depression 3 delimited by rim area 1*a* with inner circumferential wall surface 1*b* and base 1*c*. The tilting device 4 is disposed in this depression 3. The support element 5 in this embodiment is formed by two plates 5*a*, 5*b* that are parallel to each other between which an elastic body 5*c*, in the illustrated embodiment a cylinder of elastic rubber or plastic material, is fixedly arranged. On the upper plate 5*a* of this tilting device 4, the tilting seat disk 6 is arranged. The entire thing is covered by the cover 7. The person seated on the seat plate 1, in particular on the tilting seat disk 6, can move against the spring force of the support element 5 in any direction to perform tilting movements into the annular free space A. The actual seat plate 1 remains unchanged with regard to its position in this situation. As a result of the spring force of the supporting element, the person must overcome a counter force.

Figure 2B:
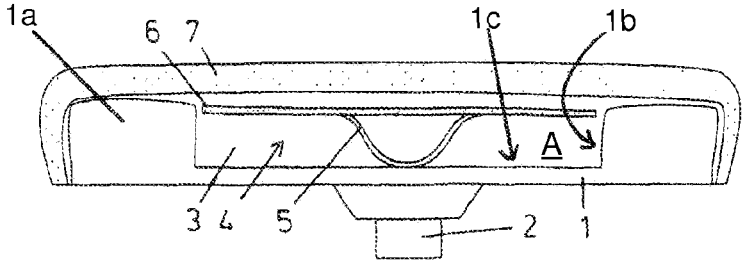

The embodiment of FIG. 2*b* differs from that of the embodiment in FIG. 2*a* by the support element 5. In this embodiment in FIG. 2*b*, this support element 5 is embodied as a seesaw of sorts.

Figure 2C:
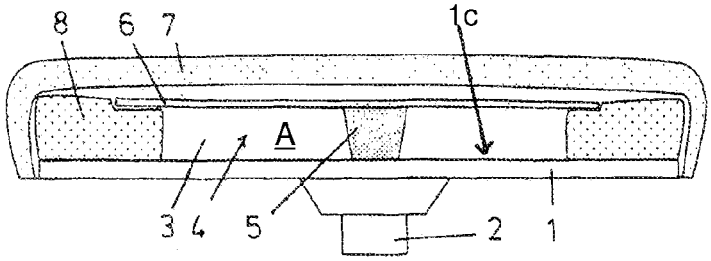

The embodiment of FIG. 2*c* differs from the embodiment in FIGS. 2*a* and 2*b* in that the rim area of the seat plate 1 for forming the afore described depression 3 is formed by an annular spring device 8. The latter can be an elastic material. On this spring device 8 the circumferential rim of the tilting seat disk 6 is resting. The central support element 5 is embodied as an elastic body and is connected fixedly with the bottom side of the tilting seat disk 6. In other respects, the tilting device 4 (as in the afore described embodiments and as in the following embodiments) can be simply placed as a separate component onto the seat plate 1. In the embodiment in FIG. 2*c*, the annular spring device 8 generates a counter force when a tilting movement occurs.

Figure 2D:
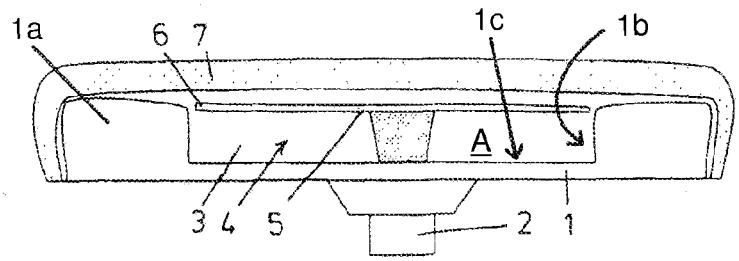

In the embodiment in FIG. 2*d*, the tilting seat disk 6 only extends to the rim of the depression 3 (as already in the embodiments of FIGS. 2*a* and 2*b*). As a support element 5 an elastic body is provided here, as in the embodiment in FIG. 2*c*.

Figure 2E:
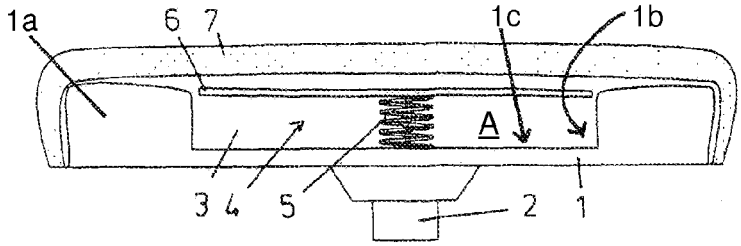

The embodiment of FIG. 2*e* differs from the embodiment in FIG. 2*d*. The difference resides only in that the support element 5 is formed by a coil spring.

Figure 2F:
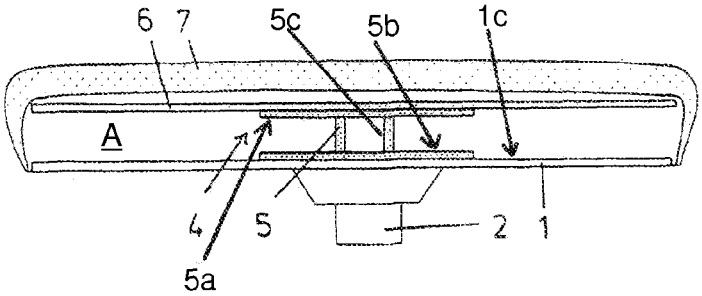

The embodiment in FIG. 2*f* differs finally from the aforementioned embodiments in that no depression 3 is provided here. The actual seat plate 1 is of a flat configuration. On it the tilting device 4 is supported. The tilting seat disk 6 extends here to the rim of the actual seat plate 1. The support element 5 is in the form of the device as has already been illustrated and described in FIG. 2*a*.

Figure 3A:
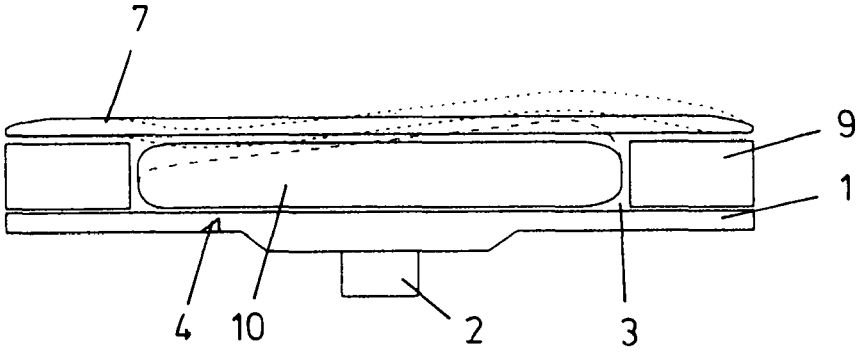
FIGS. 3*a* to 3*c* section illustrations of the piece of seating furniture in further different embodiments utilizing a cushion as a tilting device.
Figure 3B:
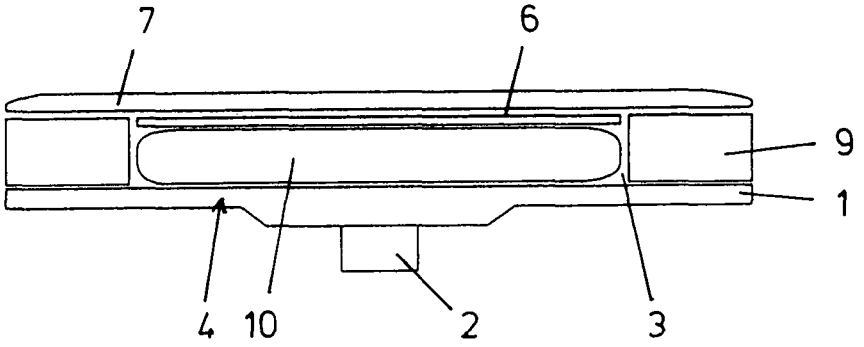
Figure 3C:
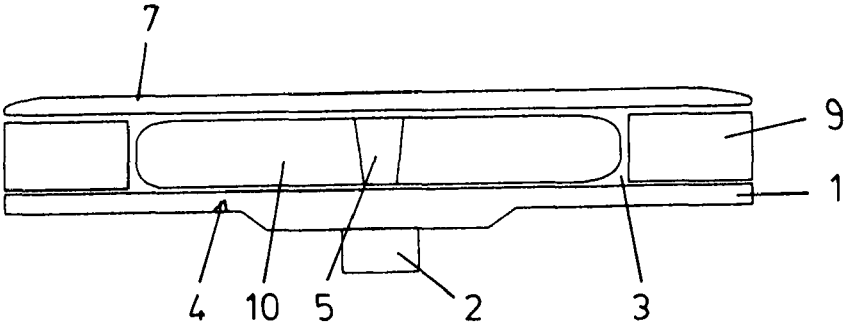

FIGS. 3*a* to 3*c* show further embodiments of the tilting device 4 for a piece of seating furniture. The principle here is that the seat plate 1 has a depression 3. This depression 3 is formed in that the seat plate 3 is provided with a circumferentially extending ring 9. The latter can be either monolithic with the seat plate 1 or can also be attached as a separate component to the seat plate 1.

It is important in this context that as a tilting device 4 a flat cushion 10 is provided which is positioned within the depression 3. This cushion 10 is filled with a flowable medium, for example, air, water, or a gel. Above the cushion 10 there is also a cover 7.

The function is as follows:

In FIG. 3*a* in solid lines the initial situation is illustrated initially. When a person seated on the piece of seating furniture moves laterally, this forces the flowable medium in the cushion 10 from the corresponding side to the other side of the cushion 10 which is therefore correspondingly bulging. This is indicated by the dashed lines. When the person then performs a movement in the opposite direction, the medium flows back within the cushion 10.

FIG. 3*b* shows the piece of seating furniture as in FIG. 3*a* but with the difference that additionally on the cushion 10 a tilting seat disk 6 is arranged.

The embodiment of FIG. 3*c* finally shows that the cushion 10 in the central area has a support element 5. However, the latter can also be arranged off-center. Also, several support elements 5 can be provided. Different profilings are conceivable, including the configuration of the support element 5 in form of a bar. By providing a special configuration of the support element 5 or the supporting elements 5, it is possible to provide different tilting characteristics.

Figure 4A:
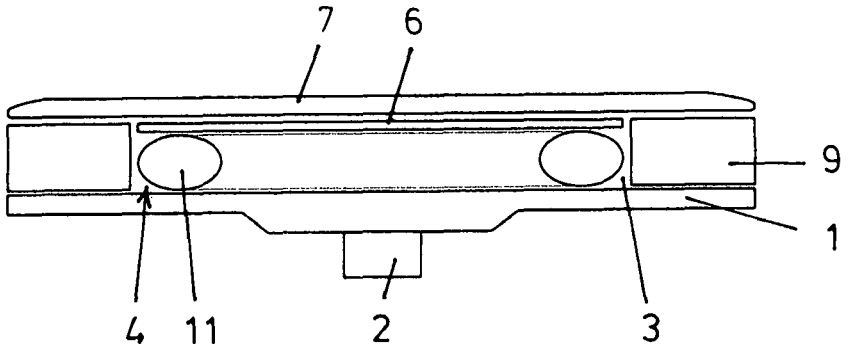
FIGS. 4*a* and 4*b* section illustrations of the piece of seating furniture in further different embodiments utilizing an annular hose as a tilting device.
Figure 4B:
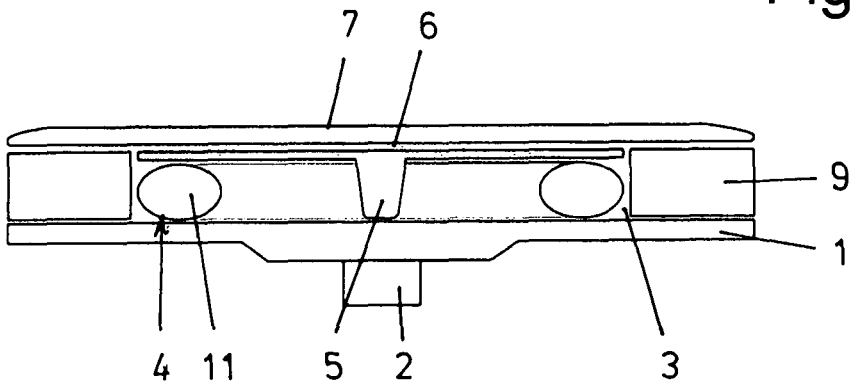

FIGS. 4*a* and 4*b* show further embodiments of the tilting device 4 for a piece of seating furniture.

Here, the principle is also that the seat plate 1 has a depression 3. In this embodiment, as a tilting device 4 an annular hose 11 is provided which is disposed in the depression 3. As in the case of the cushion 10, this annular hose 11 is filled with a flowable medium, for example, air, water, or a gel. Initially, according to FIG. 4*a*, on this annular hose 11 a tilting seat disk 6 is positioned which is resting with its rim on the annular hose 11.

In addition, this tilting seat disk 6 according to FIG. 4*b* can also have a support element 5. The latter is arranged in the central recess of the annular hose 11 and can be profiled discretionarily.

LIST OF REFERENCE CHARACTERS

1 seat plate
2 seat substructure
3 depression
4 tilting device
5 support element
6 tilting seat disk
7 cover
8 annular spring device
9 ring
10 cushion
11 annular hose

The invention claimed is:

1. A piece of seating furniture comprising:

a seat plate comprising a base and a rim area with an inner circumferential wall surface, the base and the inner circumferential wall surface defining a depression;

a seat substructure arranged at a bottom side of the base of the seat plate;

a tilting device with which a person seated on the piece of seating furniture can perform a tilting movement about a pivot point arranged within a seating area of the piece of seating furniture;

wherein the tilting device is a unit that is embodied separate from the seat plate and is arranged on the seat plate, wherein a person is seated directly on the tilting device;

wherein the tilting device comprises a support element comprising a first end and an opposed second end;

wherein the tilting device further comprises a tilting seat disk connected to the first end of the support element;

wherein the support element is disposed in the depression such that the second end is arranged centrally on the base and the tilting seat disk is facing upwardly;

wherein an annular free space is defined between the inner circumferential wall surface and an outer circumference of the support element;

wherein the tilting seat disk has a diameter that is smaller than an inner diameter of the inner circumferential wall surface so that the tilting seat disk can tilt into the annular free space when a person seated on the tilting device carries out a tilting movement.

2. The piece of seating furniture according to claim 1, wherein a circumferential rim of the tilting seat disk is positioned at a spacing above the seat plate.

3. The piece of seating furniture according to claim 1, wherein the support element is a rigid body.

4. The piece of seating furniture according to claim 1, wherein the support element is an elastic spring element that produces a counterforce for the tilting movement.

5. The piece of seating furniture according to claim 1, wherein the tilting device is arranged exclusively within the depression.

6. The piece of seating furniture according to claim 1, further comprising a common cover that encloses the seat plate and the tilting device.

7. The piece of seating furniture according to claim 1, wherein the seat plate and the seat substructure are rigidly connected to each other.

8. The piece of seating furniture according to claim 1, wherein the seat plate and the seat substructure are connected to each other by a tilting mechanism or a synchronizing mechanism.

9. A piece of seating furniture comprising:

a seat plate comprising a base and a rim area with an inner circumferential wall surface, the base and the inner circumferential wall surface delimiting a depression;

a seat substructure arranged at a bottom side of the base of the seat plate;

a tilting device with which a person seated on the piece of seating furniture can perform a tilting movement about a pivot point arranged within a seating area of the piece of seating furniture;

wherein the tilting device is a unit that is embodied separate from the seat plate and is arranged on the seat plate, wherein a person is seated directly on the tilting device;

wherein the tilting device comprises a support element comprising a first end and an opposed second end;

wherein the tilting device further comprises a tilting seat disk connected to the first end of the support element;

wherein the support element is disposed in the depression such that the second end is arranged centrally on the base and the tilting seat disk is facing upwardly;

wherein an annular free space is defined between the circumferential wall surface and an outer circumference of the support element;

wherein the tilting seat disk has a diameter that is greater than an inner diameter of the inner circumferential wall surface;

wherein the rim area is springy and a circumferential rim of the tilting seat disk of the tilting device is resting on the rim area of the seat plate.

10. The piece of seating furniture according to claim 9, wherein the rim area is an annular spring device arranged on the base and extending between the tilting seat disk and the seat plate.

11. The piece of seating furniture according to claim 9, further comprising a common cover that encloses the seat plate and the tilting device.

12. The piece of seating furniture according to claim 9, wherein the seat plate and the seat substructure are rigidly connected to each other.

13. The piece of seating furniture according to claim 9, wherein the seat plate and the seat substructure are connected to each other by a tilting mechanism or a synchronizing mechanism.

14. The piece of seating furniture according to claim 9, wherein the support element is a rigid body.

* * * * *